United States Patent [19]

Klingenberg

[11] 4,002,020

[45] Jan. 11, 1977

[54] FOUR-SIDED WATER-RESISTANT WATCH-CASE

[75] Inventor: Hans Ulrich Klingenberg, St. Niklaus near Merzligen, Switzerland

[73] Assignee: Century Time Ltd., Switzerland

[22] Filed: Oct. 30, 1974

[21] Appl. No.: 519,293

[30] Foreign Application Priority Data

Nov. 9, 1973 Switzerland ..... 15758/73

[52] U.S. Cl. ..... 58/90 R

[51] Int. Cl.[2] ..... G04B 37/08

[58] Field of Search ..... 58/88 R, 90 R

[56] References Cited

UNITED STATES PATENTS

| | | | |
|---|---|---|---|
| 2,514,906 | 7/1950 | Steimann | 58/90 R |
| 3,729,924 | 5/1973 | Aoki | 58/90 R |

FOREIGN PATENTS OR APPLICATIONS

| | | | |
|---|---|---|---|
| 215,448 | 9/1941 | Switzerland | 58/90 R |

*Primary Examiner*—George H. Miller, Jr.
*Attorney, Agent, or Firm*—Stevens, Davis, Miller & Mosher

[57] ABSTRACT

A four-sided, water-resistant watch-case comprising a caseband having a plane upper face, a crystal made of an inorganic material, an annular gasket inserted between the crystal and the caseband, and a bezel fastened to the caseband, partially covering the plane upper face, and holding the crystal in place, wherein the crystal comprises bevels along its periphery, and the bezel comprises a frame having inner faces in the form of ruled surfaces generated by lines perpendicular to said plane upper face, feet integral with the frame, projecting from the surface of the bezel facing the caseband and engaged in openings in the plane upper face, and claws projecting inwardly from opposite sides of the frame, the inner faces surrounding the gasket over at least part of its thickness, and the claws pressing upon the bevels in order to press the crystal against the gasket.

3 Claims, 3 Drawing Figures

FOUR-SIDED WATER-RESISTANT WATCH-CASE

This invention relates to a four-sided, water-resistant watch-case comprising a caseband having a plane upper face, a crystal made of an inorganic material, an annular gasket inserted between the crystal and the caseband, and a bezel fastened to the caseband, partially covering the plane upper face thereof, and holding the crystal in place.

Crystals made of an inorganic material, e.g., of a mineral such as sapphire or of hardened natural glass, are used in fine-quality watch-cases. Thus they are frequently used in association with casebands which are made of a material resistant to deterioration or which have undergone surface treatment. Now, casebands of this type are often formed so as to exhibit large, plain visible surfaces, for it has been found that such surfaces make them particularly attractive.

For round watch-cases of this kind, means are already known for fastening the crystal to the caseband so as to ensure that the joint between those two parts is water-resistant and, at the same time, to contribute to the attractive appearance of the watch-case. However, these known fastening means require that the upper face of the caseband be frustoconical in shape, and that shape cannot be retained in the case of four-sided watch-cases. On the other hand, the known fastening means suitable for use with crystals made of inorganic material and applicable to four-sided watch-cases are generally heavy, bulky, and not very reliable. Thus there are designs where the periphery of the crystal is cemented to a ring which projects beyond the crystal on the outside, the projecting portion being engaged under a rim formed by an undercut in the bezel. The latter may be screwed to the caseband by screws having their heads accommodated under the lower face of the caseband. With watch-cases of this type, besides the fact that the bulky bezel with the rim all along its inner periphery gives the watch-case a heavy look, the water-resistance and the fastening of the crystal depend completely upon how reliably the crystal is cemented to its supporting ring.

It has also been proposed to use a frame-like bezel secured to the flat surface of the caseband by screws and having bevelled inner faces which engage on the entire bevelled periphery of the crystal. However, a design of this kind necessitates very precise adjustment of all the bevels of the bezel with respect to those of the crystal, and such precise adjustment is not easy to obtain under efficient manufacturing conditions. Another drawback of this known design is that it masks the bevels of the crystal, whereas it is actually desirable to allow at least the greater part of the bevelling to show.

It is the object of this invention to remedy these drawbacks and to provide a four-sided water-resistant watch-case having an inorganic crystal and a flat caseband which can be efficiently produced and has a particularly attractive and distinguished appearance.

To this end, in the watch-case according to the present invention, the crystal comprises bevels along its periphery, and the bezel comprises a frame having inner faces in the form of ruled surfaces generated by lines perpendicular to the plane upper face of the caseband, feet integral with the frame, projecting from the surface of the bezel facing the caseband and engaged in openings in the plane upper face thereof, and claws projecting inwardly from opposite sides of the frame, the inner faces of the frame surrounding the gasket over at least part of its thickness, and the claws pressing upon the bevels of the crystal in order to press the crystal against the gasket.

Two possible embodiments of the invention will now be described in detail with reference to the accompanying drawing, in which.

Figure 1:
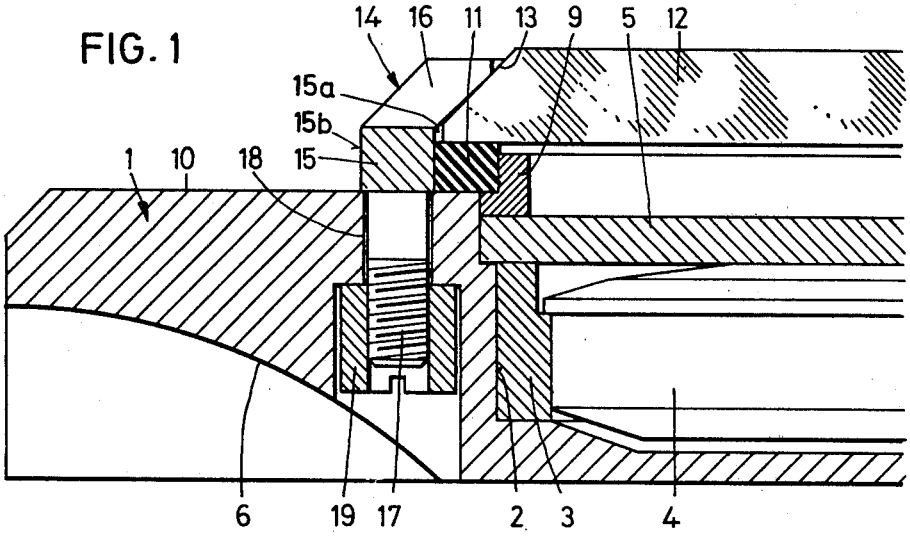
FIG. 1 is a partial axial section of the first embodiment.
Figure 3:
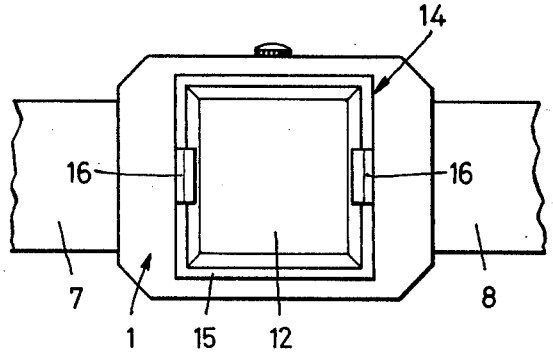
FIG. 3 is a top plan view on a smaller scale of the embodiments of FIGS. 1 and 2.

The watch-case shown in FIG. 1 is of the monocoque type. It comprises a combined caseband-and-back 1, generally rectangular in shape, having a square central housing 2 accommodating an enlarging ring 3, a movement 4, and a dial 5 covering the movement 4. In the lower face of the caseband 1, at the two ends of it which are oriented along the 12 o'clock/6 o'clock axis, are recesses 6 extending over only part of the width of the caseband and intended for the engagement of bars for attaching a watch-bracelet. As may be seen in FIG. 3, two elements 7 and 8 of the bracelet continue out from the watch-case, the caseband 1 of which covers the aforementioned bars. Set upon the dial 5 is a square ring 9 constituting a flange and having a shoulder in its outer edge, the thinner portion of the ring 9 projecting above the upper face 10 of the caseband. The entire surface of the upper face 10 is plane. It supports a gasket 11, the dimensions of which are such that it protrudes slightly inside the housing 2 into the shoulder of the ring 9. A crystal 12 is made of an inorganic material, e.g., sapphire. Its upper and lower surfaces are both plane, and its lateral faces 13 are bevelled at an angle of about 45°, the lower edge of the crystal being chamfered so that it may be adjusted precisely.

The crystal 12 is secured to the caseband 1 by means of a bezel 14 (FIGS. 1 and 3) comprising a square frame 15, two fastening claws 16 projecting from the centers of the sides of the frame corresponding to 12 o'clock and 6 o'clock, and two fastening feet 17 which are aligned with the claws 16, and the lower ends of which are threaded. The frame 15 and the claws 16 may be machined in one piece, the feet 17 being attached to the frame 15 by soldering, for instance, like conventional dial-feet. However, the whole of the bezel 14 might also be machined from a single piece. It may be made of a nickel or copper alloy, or it may also be made of gold.

As may be seen in FIG. 1, the claws 16 extend obliquely upwards and inwards starting from the frame 15, which is rectangular in profile. The inner and outer lateral faces **15*a* and 15*b* of the frame 15 are plane, parallel, and perpendicular to the face 10. The four inner faces 15*a* are engaged on the gasket 11 so that it can be squeezed against the flange 9. They also surround the lower part of the crystal 12. The feet 17 engage in cylindrical bores 18 made in the middle of each of the short sides of the caseband 1. The bores 18 pass through the caseband 1 down to the recesses 6, their lower portions being larger in diameter than their upper portions. The crystal 12 is fixed in place by screwing nuts 19 on each of the feet 17. The claws 16 then press on the bevelled lateral faces 13 of the crystal 12 and squeeze the crystal 12 at two directly opposite points against the gasket 11, which in turn presses on the face 10 of the caseband 1. Thus the water-resistant closing of the watch-case is obtained, and the gasket 11 holds the flange 9, the dial 5, and the movement 4 vertically in place. The feet 17 are freely engaged in the bores 18 so that the frame 15 may be centered with respect to the ring 9, which is itself adjusted to the opening in the caseband 1, upon engagement of the bezel 14 on the gasket 11. This is possible even if the dimensions of the frame 15 differ slightly, within the limits of the admissible tolerance, from the nominal dimensions specified for the construction. The dimensions of the crystal 12 at the base of its bevelled faces 13 are such that it may engage freely in the frame 15. Because of the pressure exerted by the claws 16 on the two bevelled faces 13 situated at 12 o'clock and 6 o'clock, the crystal 12 will likewise be centered with respect to the frame 15. As the claws 16 are provided only on two opposite sides of the frame 15, they press on the crystal 12 with equal force. This arrangement does not require very strict tolerances for the specified dimensions of the bevelled faces 13, which is a particular advantage when a very hard material such as sapphire is being used. With the arrangement illustrated in FIG. 1, the gasket 11, rectangular in profile, is squeezed on its four sides between the plane upper face 10 of the caseband 1, the outer faces of the ring 9, the plane inner faces 15***a* of the frame 15, and the lower face of the crystal 12. As may be seen in FIG. 3, the claws 16 extend only over less than one-third of the total length of the sides of the frame 15, so that the bevelled faces 13 are completely visible for most of their surface. In the embodiment illustrated in FIG. 1, the dial 5 may consist of a thin plate made of synthetic stone, while the caseband 1 is made of metal. This metal may be the same one used for the frame 15 or a different one. It may have been subjected to the same surface treatment or to different treatments, e.g., treatments intended to improve its resistance to wear.

Figure 2:
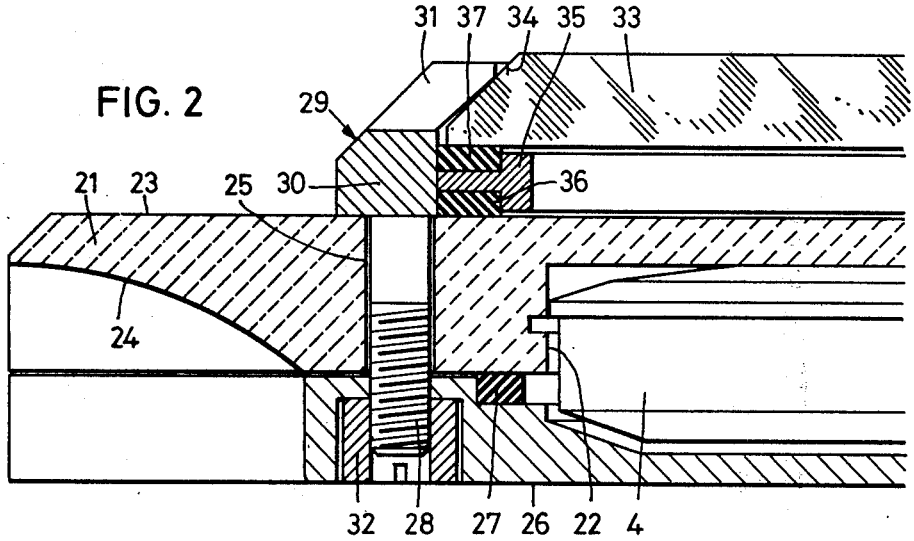
FIG. 2 is a partial axial section of the second embodiment.

The embodiment shown in FIG. 2 makes it possible to use an inorganic material such as synthetic stone for the caseband. Here, a caseband 21 consists of an elongated rectangular plate having a housing 22 contrived in its lower face to accommodate the movement 4, and two recesses 24 situated at the ends of it, analogous to the recesses 6 of the first embodiment, for the engagement of the bars of the bracelet. The upper face 23 of the caseband 21 is entirely plane and is cut at the center only by a circular hole (not shown) through which the staffs of the hands are intended to pass. The caseband 21 likewise has two cylindrical bores 25, each in the middle of one of its short sides and passing completely through it.

The watch-case illustrated in FIG. 2 also comprises a separate back 26 which is secured against the lower face of the caseband 21 with a conventional gasket 27 interposed. In this embodiment, too, the watch-case is then kept closed by means of fastening feet 28 forming part of a bezel 29 which, like the bezel 14, is composed of a frame 30 and two claws 31 in line with which the fastening feet 28 are joined to the frame 30. The fastening feet 28 pass through the caseband 21 and through bores in the back 26. The assembly is fixed by means of nuts 32 countersunk in recesses in the lower face of the back 26.

The two claws 31 hold in place a crystal 33 of the same shape as the crystal 12 and likewise having bevelled lateral faces 34 upon which the two claws 31 press. Various arrangements may be provided for ensuring the necessary space between the plane upper face 23 of the caseband 21 and the likewise plane lower face of the crystal 33. In the embodiment described here, a flange 35 is disposed between those two parts. Its outer portion takes the form of a thin, flat fin, the outer contour of which is adjusted to the inner contour of the frame 30, and two gaskets 36 and 37 are interposed, one between the caseband 21 and the fin of the flange 35, and the other between this fin and the crystal 33. Through tightening of the nuts 32 on the fastening feet 28, the frame 30 is caused to press against the face 23 of the caseband 21, and the claws 31 press the crystal 33 towards the caseband 21, squeezing the gaskets 36 and 37. The nuts 32 are tightened until the frame 30 rests on the face 23. At the same time, the peripheral portion of the back 26 is pressed against the lower face of the caseband 21 and squeezes the gasket 27.

This embodiment makes it possible to produce the dial and the caseband in one piece. Because it is of such a simple shape, this piece may be made of a material which is relatively complicated to machine, such as ruby, for example.

In other possible embodiments, there might also be four claws, two on the 12 o'clock/6 o'clock axis and two on the 3 o'clock/9 o'clock axis. In this case, the fastening part would comprise four feet. It has been found that when a crystal made of inorganic material is secured against a gasket at specific points, as by means of the claws 16 and 31, for example, excellent water-resistance is obtained. Since the feet are disposed in line with the fastening claws, they directly transmit to them the pressure force necessary to secure the crystal. Thus the frame 15 or 30 plays no part in the transmission of forces nor in ensuring the water-resistance. The sole function of the frame is to surround the gasket and the crystal. Hence its function is a purely aesthetic one. However, the arrangement described prevents the claws from getting lost during assembly or disassembly since all the claws are connected to one another and are integral with the same part.

As a variation, the fastening feet might be attached to the caseband or to the back by means other than the nuts 19 and 32 described above. In particular, bolts engaged with the caseband might also be used.

It follows from the foregoing that the design described is applicable to other crystal shapes than the square or rectangular crystal. Thus the crystal might have four cambered sides, etc.

In the embodiment according to FIG. 2, the thin central wall between the housing 22 for the movement 4 and the upper face 23 of the caseband 21 might be designed with a concave or convex upper face instead of a flat one. This wall, which might also be called a screen, might also be so thin, when made of synthetic stone, as to be translucent or even transparent, and it might cover the entire display of the watch. In this case, the crystal would merely constitute a protection against shocks or harmful effects of the environment, but not necessarily ensuring water-resistance.

Finally, as regards the fastening feet, it would also be possible to provide two feet per claw, both of these feet being aligned with the corresponding claw.

What is claimed is:

1. A four-sided water-resistant watch-case comprising:

a caseband having a plane upper surface and an opening therein for receiving a watch movement;

an annular gasket disposed on said plane upper surface adjacent said opening;

a crystal made of inorganic material covering said opening and resting on a top surface of said gasket, said crystal having outwardly beveled side portions extending from a top planar surface of the crystal part-way to a bottom coplanar surface of the crystal;

a bezel mounted to said caseband on said plane upper surface, said bezel comprising a frame having a main body portion surrounding said annular gasket and having an inner face, the plane of which is substantially perpendicular to said plane upper surface, contacting a complementary outer face of said gasket, said inner face extending upwardly from said plane upper surface toward but not higher than the bottom beveled edge of said crystal side portions, and at least one pair of oppositely disposed claw members extending upwardly from said main body portion and contacting corresponding ones of said beveled side portions, said claw members each having an inner face extending from said main body portion inner face and forming an angle of greater than 90° with respect to said inner face, said inner faces of said claw members engaging the beveled side portions of said crystal, each of said claw members having a length substantially less than the length of the side of said frame from which said claw member extends such that the beveled portions of the crystal engaged with said claw members remain largely uncovered; and means securing said bezel to said caseband whereby said claw members press against said beveled side portions of said crystal to press said crystal against said gasket.

2. A watch-case in accordance with claim 1, wherein said caseband is formed in one piece with a back.

3. A watch-case in accordance with claim 1, means for mounting the bezel comprising feet integral wtih said frame projecting from the surface of said bezel facing said caseband and engaged in openings in said plane upper surface, wherein said feet are threaded, and further comprising nuts borne by the ends of said feet.

* * * * *